US005404204A

United States Patent [19]

Swinkels

[11] Patent Number: 5,404,204

[45] Date of Patent: Apr. 4, 1995

[54] DISPLAY TUBE INCLUDING A DEFLECTION UNIT

[75] Inventor: Petrus H. W. Swinkels, Endhoven, Netherlands

[73] Assignee: U.S. Philips Corporation, New York, N.Y.

[21] Appl. No.: 222,131

[22] Filed: Apr. 1, 1994

[30] Foreign Application Priority Data

May 13, 1993 [BE] Belgium ..... 09300493

[51] Int. Cl.[6] ..... H01J 29/82; H01J 29/70

[52] U.S. Cl. ..... 335/211

[58] Field of Search ..... 335/210–214; 313/440; 315/8

[56] References Cited

U.S. PATENT DOCUMENTS

| | | | |
|---|---|---|---|
| 4,246,560 | 1/1981 | Shimizu et al. | 335/212 |
| 4,307,363 | 12/1981 | McGlashan | 335/211 |
| 4,357,586 | 11/1982 | Barkow et al. | 335/211 |
| 4,386,331 | 5/1983 | Kohzuki et al. | 335/211 |
| 4,409,578 | 10/1983 | Beelaard et al. | 335/210 |
| 4,823,046 | 4/1989 | Sluyterman | 313/431 |
| 5,250,876 | 10/1993 | Van Mierlo et al. | 313/440 |

*Primary Examiner*—Gerald P. Tolin
*Assistant Examiner*—Raymond M. Barrera
*Attorney, Agent, or Firm*—Paul R. Miller

[57] ABSTRACT

Display tube including a deflection unit which comprises a coil support (8), a field deflection coil (12), a line deflection coil (11) and a yoke ring (14). Plate-shaped metal field correction elements (15, 15', 15'') are arranged between the field deflection coil (12) and the coil support (8), which elements are rigidly secured to the inner surface of the yoke ring by means of a form-filling adhesive which extends between the parts of the field deflection coil. Vibrations of the field correction elements and sound generated by transfer of these vibrations to the coil support are thereby substantially prevented.

8 Claims, 3 Drawing Sheets

DISPLAY TUBE INCLUDING A DEFLECTION UNIT

BACKGROUND OF THE INVENTION

The invention relates to a display tube including a deflection unit which comprises a coil support, an inner (line) deflection coil, an outer (field) deflection coil, a yoke ring and at least one plate-shaped metal correction means arranged within the outer (field) deflection coil.

A display tube of this type may be used in monochrome, color and projection television, in data display apparatus and in other apparatus in which cathode ray tubes are used.

Upon energization, the deflection unit generates magnetic deflection fields so as to deflect electron beams generated in the display tube for forming a picture on the display screen of the display tube. To influence the distribution of the field deflection field, it is common practice to arrange a correction means made of thin, soft-magnetic sheet material within the field deflection coil, for example, for improving the convergence.

In some cases it appears that an unwanted sound which is irritating to a user is caused during picture display.

SUMMARY OF THE INVENTION

It is an object of the invention to provide a display tube in which the occurrence of an unwanted sound during picture display is at least substantially prevented.

According to the invention, a display tube of the type described in the opening paragraph is therefore characterized in that the correction means is rigidly secured to the inner surface of the yoke ting by means of a form-filling adhesive which extends between the field deflection coil potions. In accordance with an embodiment, the correction means is arranged between the coil support and the field deflection coil, because this facilitates positioning of the correction means.

The invention is based on the recognition that the occurrence of an unwanted sound is largely caused by the fact that the fields generated upon energization of the deflection unit lead to an unwanted vibration of the correction means which is secured to the coil support in the conventional constructions. These vibrations are passed on to the mechanical support (coil support) which produces the sound (acoustic radiator). By securing, according to the invention, the correction means to a deflection unit component having a high rigidity and mass (the yoke ting) and being preferably isolated mechanically from the coil support as much as possible, this unwanted sound generation can be substantially prevented throughout the range of temperatures used in practice. Isolated mechanically is understood to mean that possible vibrations of the correction means cannot be transferred or can hardly be transferred to the coil support. To this end, the coil support may be provided with, for example an aperture opposite the correction means. The correction means may project into or through this aperture. Alternatively, a material inhibiting the transfer of vibrations may be present between the correction means and the coil support.

According to the invention, the yoke ring is used for securing the correction means by means of a rigid connection to a deflection unit component having a high rigidity and mass. Consequently, mechanical resonances (including rigid body modes) of the correction means are suppressed. A form-filling electrically insulating epoxy is preferably used for the rigid connection. In the special use of a correction means in the form of a central portion having two limbs projecting at an angle (for example in a plane transverse to the longitudinal axis) it is not possible to secure the entire correction means. In that case the ends of the limbs may still be excited. By providing elongate apertures in the mechanical support at the area of the correction means portions not secured to the yoke ring it can be ensured that these vibrations are not transferred to the mechanical support.

The adhesive is preferably an electrically insulating epoxy material.

In accordance with an embodiment of the invention the correction means comprises two elements made of a soft magnetic sheet material, which elements are arranged diametrically opposite each other between the field deflection coil and the coil support substantially parallel to the magnetic field of the field deflection coil. A considerable reduction of the sound pressure level is also obtained in this case.

The invention is not so much used for damping vibrations (which would be the case to a certain extent if the correction-means were to be enveloped with a damping material), but rather to ensure that the correction means (made of thin sheet material) substantially cannot be caused to vibrate Coy rigid connection to the yoke ting) or, if the correction means or its ends should nevertheless start to vibrate, to ensure that these vibrations cannot be transferred to the coil support.

BRIEF DESCRIPTION OF THE DRAWING

These and other aspects of the invention will be apparent from and elucidated with reference to the embodiment described hereinafter.

In the drawings

DESCRIPTION OF THE PREFERRED EMBODIMENTS

Figure 1:
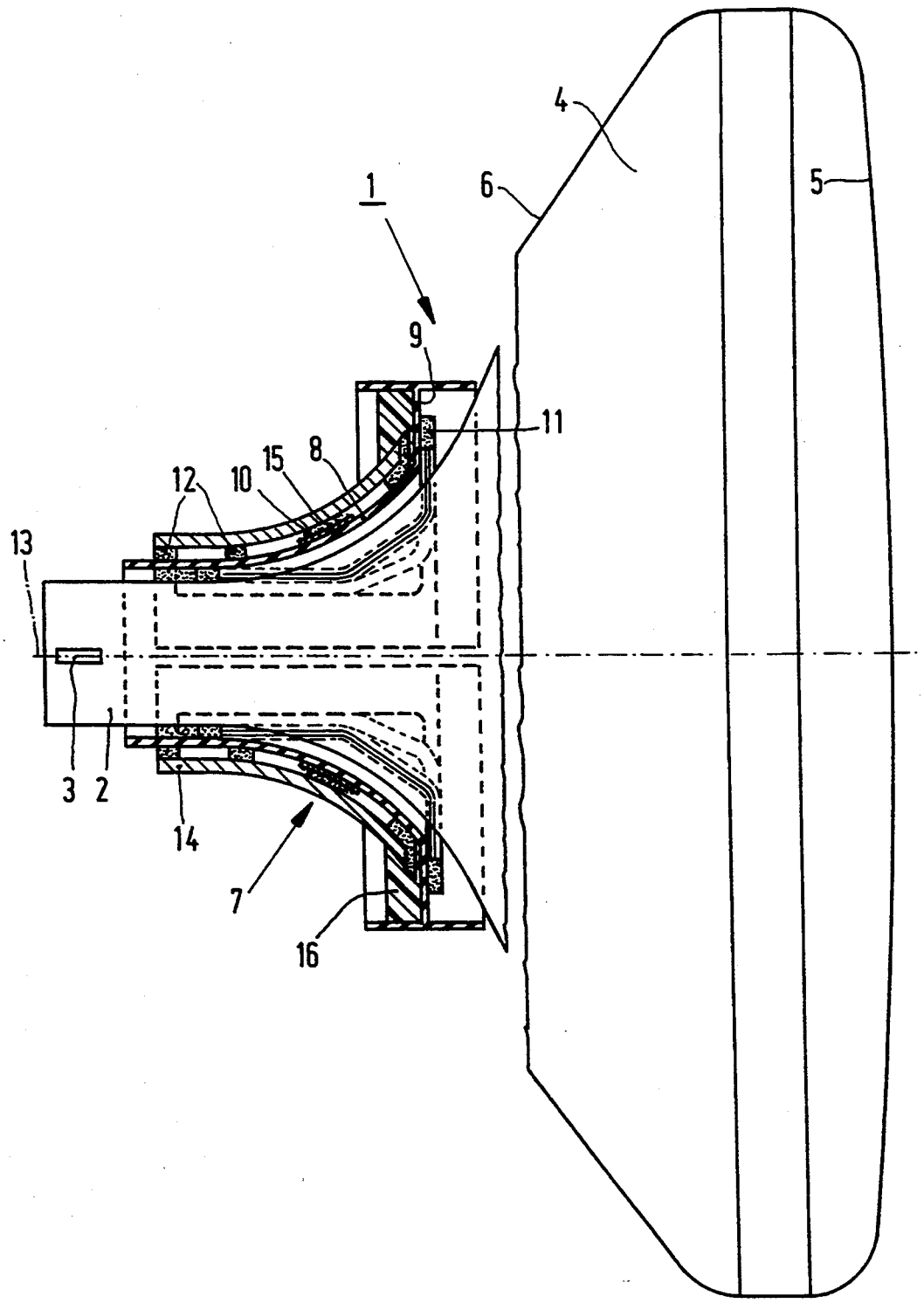
FIG. 1 is a diagrammatic longitudinal section of a display tube including a deflection unit with field correction means according to the invention.

FIG. 1 is a longitudinal section of a display tube 1 having a neck portion 2 in which an electron gun system 3 is mounted, a conical envelope portion 4 and a display window 5. At the interface between the neck portion 2 and the envelope portion 4 a deflection unit 7 is mounted on the display tube 1. This deflection unit 7 comprises a coil support 8 of electrically insulating material having a front end 9. A line deflection coil 11 for generating a (line) deflection field for deflection in the horizontal direction of electron beams produced by the electron gun system 3 is arranged between these ends at the inner side of the support 8 and a field deflection coil 12 for generating a (field) deflection field in the vertical direction is arranged at the outer side of the support 8. In this case the deflection coils 11 and 12 are surrounded by a yoke ring 14 of sintered ferromagnetic material. In the relevant case the field deflection coil is of the saddle type. The shape and positioning of field deflection coils of the saddle type particularly provides the possibility of rigidly securing convergence (astigmatic) error correction elements directly to the yoke ting (see next paragraph). However, the invention is also applicable for toroidal field deflection coils.

In this embodiment a plate-shaped magnetic field correction means 15 of a soft-magnetic metal is arranged within the field deflection coil 12 at the outer side of the coil support 8. The field correction means 15 is rigidly secured to the inner surface of the yoke ring 14 by means of a form-filling adhesive material 10. The material is preferably electrically insulating so as to prevent short-circuit between parts of the field deflection coil.

Figure 2:
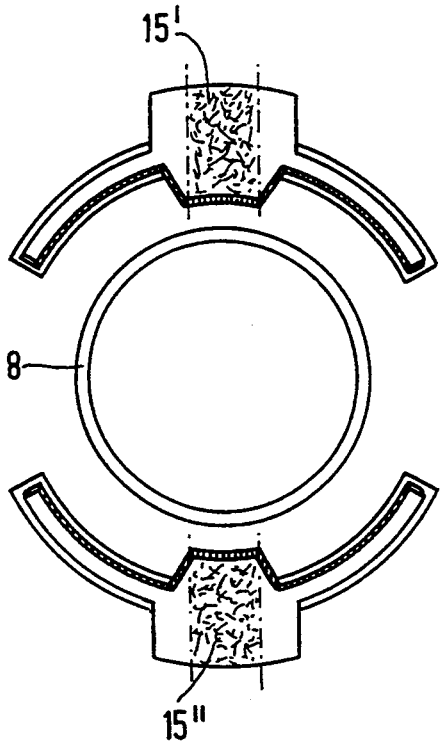
FIG. 2 is a diagrammatic elevational view of an embodiment of the field correction means.

The invention is particularly applicable to a field correction means 15 comprising two diametrical soft-magnetic elements used for influencing the deflection fields in such a way that a satisfactory level of astigmatism having an acceptably small coma error is realized (referred to as astigmatism correctors). In the assembly of the deflection unit 1 the correction means 15 may be retained in its correct position with respect to the coil support surface by means of, for example adhesive tape (20 in FIGS. 3 and 4). After the field deflection coil and the yoke ting have been positioned, the space between the yoke ring 14 and the front end 9 of the coil support 8 can be filled up with a curing synthetic resin 16 so as to fix the position of the yoke ring 14 (possibly after alignment) and the field deflection coil. The correction means 15 can be rigidly secured to the inner surface of the yoke ring 14 by injecting, from the inner side of the coil support and via one or more apertures, a form-filling adhesive at the location of the correction means 15 into the space between the correction means and the yoke ring. In this process the adhesive is injected in between the parts of the field deflection coil. As is shown diagrammatically in FIG. 2, the field correction means may be constituted by two soft-magnetic elements 15' and 15" having limbs and being arranged diametrically opposite each other and substantially parallel to the magnetic field of the field deflection coil 12. Generally only a part of the surface of the elements 15' and 15" (shown by way of example as shaded areas in FIG. 2) will be secured to the yoke ring by means of the form-filling adhesive, which is due to the presence of the field deflection coil between the coil support and the yoke ring. The ends of the limbs can then still come into vibration. To eliminate its detrimental effects, it is practical to provide the coil support with elongate apertures at areas opposite the limbs, in which apertures (the ends of) the limbs can move freely. Transfer of these vibrations to the coil support is prevented in this way.

Figure 3:
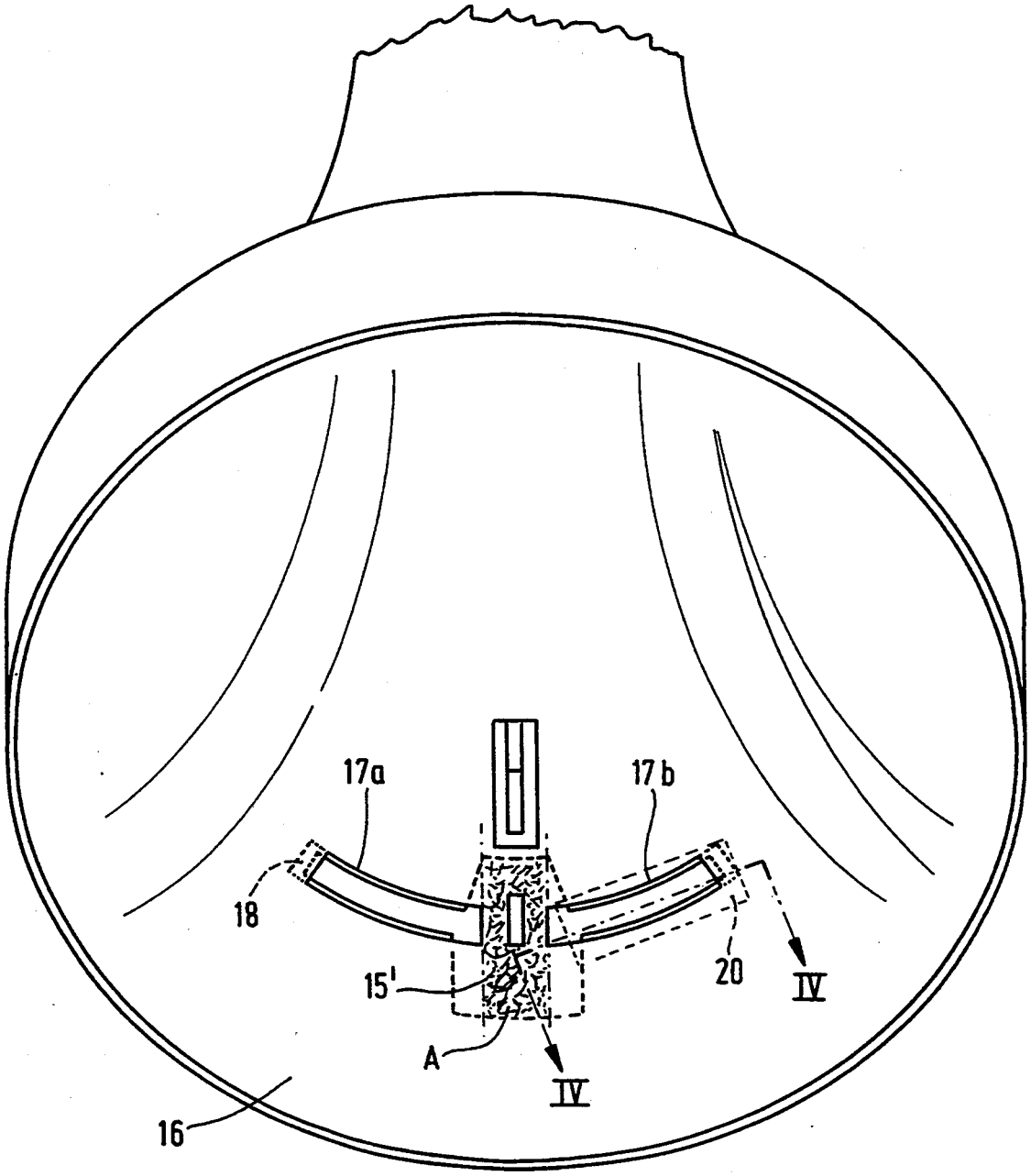
FIG. 3 is a diagrammatic elevational view of a part of the inner surface of a coil support for a display tube including a deflection unit according to the invention.

FIG. 3 is an elevational view of a part of the inner surface 16 of the coil support 8 having two elongate apertures 17*a* and 17*b*.

Figure 4:
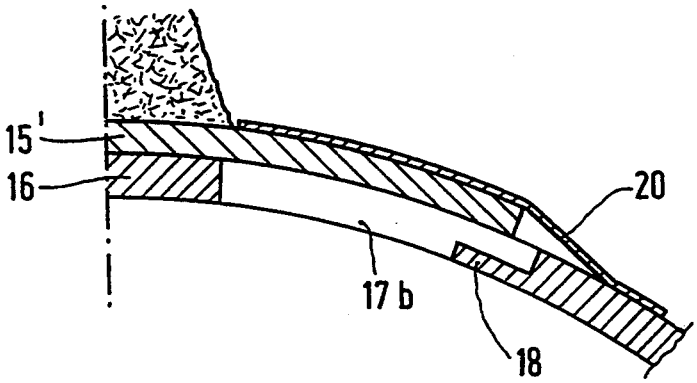
FIG. 4 is a larger detail of the construction of FIG. 3 in a cross-section.

FIG. 4 is a larger detail of the construction of FIG. 3 showing how the end of a limb of a correction element 15' can move freely with respect to the coil support 16 after it has been arranged at the position A of the coil support 16. The reference numeral 18 denotes a safety bridge preventing the end of the limb of element 15' from being deflected too far. The reference numeral 10 shows by way of illustration the adhesive with which the element 15' is rigidly secured to the inner surface of the yoke ring (not shown in FIG. 4). In a 45 AX deflection unit a sound pressure level reduction of 5 dB(A) in a cold condition (20° C.) and 10 dB(A) in a hot condition (90° C.) was achieved.

I claim:

1. A display tube including a deflection unit which comprises a coil support, an inner (line) deflection coil, an outer (field) deflection coil, a yoke ting and at least one plate-shaped metal correction means arranged within the field deflection coil, characterized in that the correction means is rigidly secured to the inner surface of the yoke ring by means of a form-filling adhesive which extends between the field deflection coil portions.

2. A display tube as claimed in claim 1, characterized in that the adhesive is an electrically insulating epoxy material.

3. A display tube as claimed in claim 1, characterized in that the correction means has a central portion comprising two limbs projecting at an angle and in that the coil support is provided with elongate apertures at locations opposite said limbs.

4. A display tube as claimed in claim 1, characterized in that the field deflection coil is of the saddle type.

5. A display tube as claimed in claim 1, characterized in that the field deflection coil is toroidally wound on the yoke ting.

6. A display tube as claimed in claim 1, characterized in that the correction means is arranged between the coil support and the field deflection coil.

7. A display tube as claimed in claim 6, characterized in that the correction means comprises two elements made of a soft-magnetic sheet material, which elements are arranged diametrically opposite each other between the field deflection coil and the coil support substantially parallel to the magnetic field of the field deflection coil.

8. A display tube as claimed in claim 1, characterized in that the correction means is substantially isolated mechanically from the coil support.

* * * * *